US008783153B2

(12) United States Patent
Sirochman

(10) Patent No.: US 8,783,153 B2
(45) **Date of Patent: *Jul. 22, 2014**

(54) SIDE HANDLE FIREARM ACTUATION SYSTEM

(71) Applicant: Joseph P. Sirochman, Peoria, AZ (US)

(72) Inventor: Joseph P. Sirochman, Peoria, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/687,651

(22) Filed: Nov. 28, 2012

(65) Prior Publication Data

US 2014/0060292 A1 Mar. 6, 2014

Related U.S. Application Data

(63) Continuation of application No. 12/843,768, filed on Jul. 26, 2010, now Pat. No. 8,333,137.

(60) Provisional application No. 61/228,453, filed on Jul. 24, 2009.

(51) Int. Cl.
*B64D 1/04* (2006.01)

(52) U.S. Cl.
USPC ..... 89/1.4; 89/191.01; 42/16

(58) Field of Classification Search
USPC ..... 89/1.4, 191.01, 179; 42/16
See application file for complete search history.

(56) References Cited

U.S. PATENT DOCUMENTS

| | | | | |
|---|---|---|---|---|
| 4,475,437 | A * | 10/1984 | Sullivan | 89/148 |
| 5,520,019 | A * | 5/1996 | Schuetz | 42/49.02 |
| 6,182,389 | B1 * | 2/2001 | Lewis | 42/16 |
| 6,418,657 | B1 * | 7/2002 | Brown | 42/124 |
| 2002/0007581 | A1 * | 1/2002 | Bucciarelli et al. | 42/98 |
| 2004/0000083 | A1 * | 1/2004 | Grant, Jr. | 42/112 |
| 2007/0199225 | A1 * | 8/2007 | Haugen | 42/85 |
| 2007/0266611 | A1 * | 11/2007 | Stover | 42/124 |
| 2010/0000396 | A1 * | 1/2010 | Brown | 89/1.4 |
| 2010/0122483 | A1 * | 5/2010 | Clark | 42/69.02 |
| 2010/0162604 | A1 * | 7/2010 | Dubois | 42/18 |
| 2010/0212201 | A1 * | 8/2010 | Kincel et al. | 42/2 |
| 2010/0269682 | A1 * | 10/2010 | Vuksanovich et al. | 89/191.01 |
| 2010/0300277 | A1 * | 12/2010 | Hochstrate et al. | 89/179 |
| 2011/0061523 | A1 * | 3/2011 | Webb | 89/128 |
| 2011/0083551 | A1 * | 4/2011 | Sirochman | 89/191.01 |
| 2011/0197491 | A1 * | 8/2011 | McCann | 42/132 |
| 2011/0214327 | A1 * | 9/2011 | Desomma | 42/75.02 |
| 2011/0252957 | A1 * | 10/2011 | Overstreet et al. | 89/128 |
| 2011/0271827 | A1 * | 11/2011 | Larson et al. | 89/193 |
| 2012/0198990 | A1 * | 8/2012 | Brittin | 89/191.01 |

* cited by examiner

*Primary Examiner* — Michelle Clement
(74) *Attorney, Agent, or Firm* — Snell & Wilmer, L.L.P.

(57) ABSTRACT

In accordance with various exemplary embodiments, a firearm actuation system is provided. The firearm actuation system, comprising a housing, a guide, a contoured actuation handle, and a bolt. The system provides an actuation mechanism for an AR-15 which is engagable by a shooter where the AR-15 is in a shouldered firing position. The contoured actuation handle may be retained in the retaining slot to provide an action-open-position. The housing may also comprise a mounting rail with a plurality of grooves, where each groove may be configured with a unique indicator.

6 Claims, 8 Drawing Sheets

SIDE HANDLE FIREARM ACTUATION SYSTEM

CROSS-REFERENCE TO RELATED APPLICATION

This application claims priority to, and the benefit of, U.S. patent application Ser. No. 12/843,768, filed on Jul. 26, 2010 (the '768 application), which issued as U.S. Pat. No. 8,333,137 on Dec. 18, 2012, and is entitled "SIDE HANDLE FIREARM ACTUATION SYSTEM," which is hereby incorporated by reference in its entirety The '768 application claims priority to Provisional Application Ser. No. 61/228,453 filed Jul. 24, 2009 and entitled "SIDE HANDLE FIREARM ACTUATION SYSTEM," which is hereby incorporated by reference in its entirety.

FIELD OF INVENTION

The disclosure herein described relates generally to firearm actuation systems, more particularly to actuation systems for AR-15 and M-16 assault rifles and other like firearms.

BACKGROUND OF THE INVENTION

Present day assault rifles, such as the "AR-15" assault rifle, have upper assemblies that employ rear-mounted actuation handles to cycle the actions (e.g. the firing pin and pin carrier) of AR-15 rifles. Typically, the rear-actuation handle is "T" shaped and is installed at the top of the upper assembly housing, below a modular rail or carry handle. The rear-mounted actuation handle engages the bolt carrier when it is pulled toward the butt-plate of the rifle stock. In order to cycle the action (operate the AR-15 rifle), this configuration requires that there be sufficient clearance between the rear-mounted actuation handle and any optic, or other accessory that may be installed on the modular rail or carry handle. Such configurations also prevent a user from cycling the action when the AR-15 rifle is shouldered in a firing position. Therefore, a longstanding need exists to provide for an actuation handle installed on the side of the upper assembly of an AR-15 rifle (or an "M-16", an AR-15 variant, and other like assault rifles and firearms).

SUMMARY OF THE INVENTION

In accordance with various exemplary embodiments, a firearm actuation system is provided. In accordance with an exemplary embodiment, a firearm actuation system, comprising a housing, a guide, a contoured actuation handle, and a bolt. In such an embodiment, the housing may define an internal cavity such that the bolt is installed with the internal cavity and allowed to actuate in at least one plane of motion. The guide may define a guide slot. Further the guide may be retainably installed within the housing such that the slot provides access to the internal cavity. The contoured actuation handle may be slidably installed within the guide slot, such that the contoured actuation handle protrudes from a side of the housing. The bolt may be installed within the housing and be engagable by the contoured actuation handle. The housing may further comprise a first feed ramp and a second feed ramp. The first and the second feed ramps may be configured to guide a plurality of alternatively arranged rounds of ammunition are advanced by the bolt along the first feed ramp and the second feed ramp. As such, the system provides an actuation mechanism for an "AR-15" assault rifle (hereinafter "AR-15") which is engagable by a shooter where the AR-15 is in a shouldered firing position. The housing may further comprise a retaining slot. The contoured actuation handle may be retained in the retaining slot to provide an action-open-position. The housing may also comprise a mounting rail with a plurality of grooves. Each groove may be configured with a unique indicator.

In an exemplary embodiment, the actuation system may be deployed is any gas operated semi-automatic firearm including for example an AR-15. The AR-15 may comprise an upper and lower assembly, a barrel assembly, and various other components. The actuation system may be configured to be at least a portion of the upper assembly.

In accordance with an exemplary method, a method for operating a firearm is provided. The method may include the steps of: providing a firearm comprising an upper receiver with a handle slidably coupled to the receiver such that the handle protrudes from the side of a the upper receiver; applying a first force to the handle, wherein the first force causes a spring loaded bolt assembly to travel to an action-open-position; applying a second three to the handle, wherein the handle is rotated into a retaining slot of the upper receiver and wherein the handle retains the spring loaded bolt assembly in an action open position; and applying a third force to the handle, wherein the handle is rotated out of the retaining slot, and wherein the spring loaded bolt assembly travels to an action-closed-position.

DETAILED DESCRIPTION

Figure 1A:
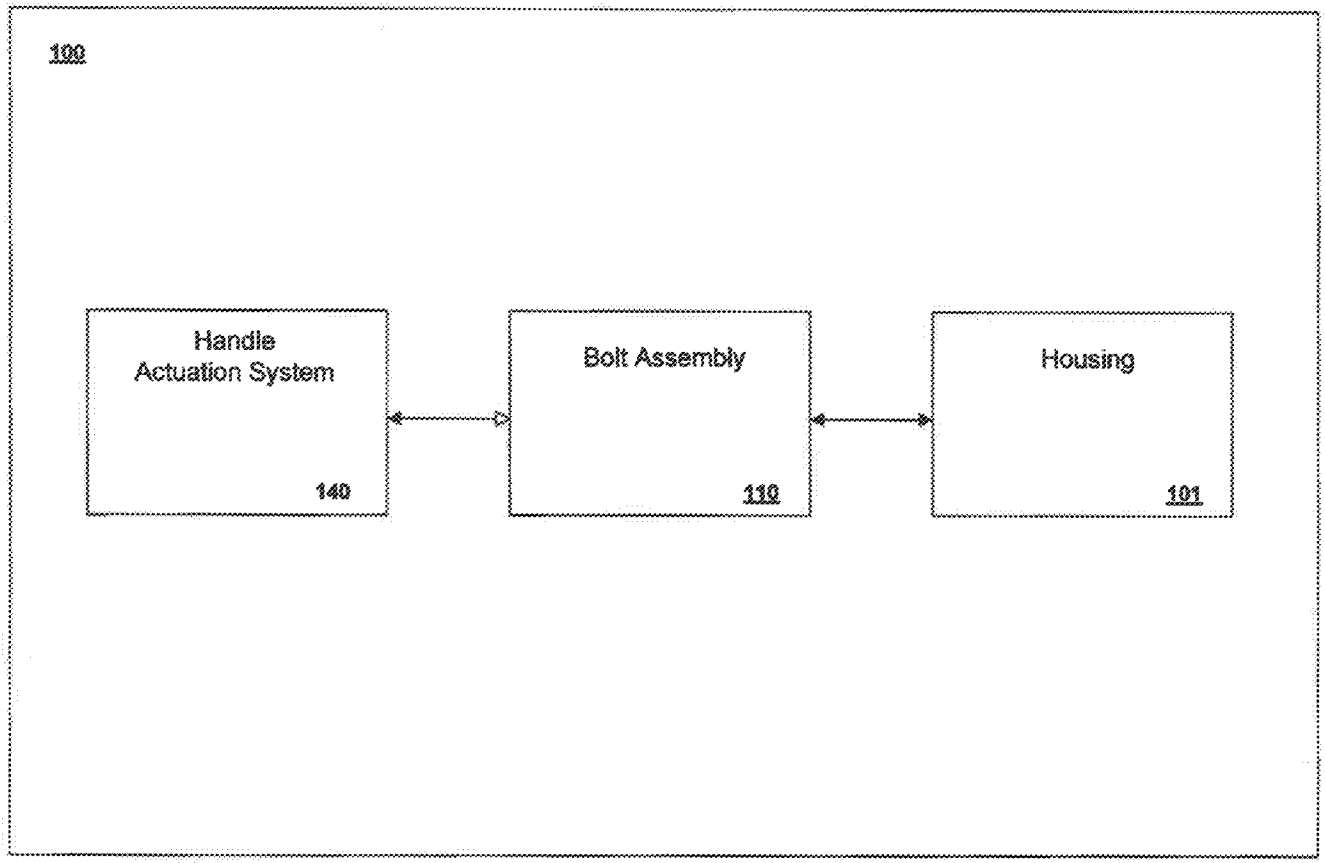
FIG. 1A is a block diagram showing various components in accordance with an exemplary embodiment.

The detailed description of exemplary embodiments herein makes reference to the accompanying drawings, which show exemplary embodiments by way of illustration and its best mode. While these exemplary embodiments are described in sufficient detail to enable those skilled in the art to practice the invention, it should be understood that other embodiments may be realized and that logical, chemical and mechanical changes may be made without departing from the spirit and scope of the invention. Thus, the detailed description herein is presented for purposes of illustration only and not of limitation. For example, the components of an assembly may be assembled in any order suitable for building a completed assembly. Moreover, many of the functions or steps may be outsourced to or performed by one or more third parties. Furthermore, any reference to singular includes plural embodiments, and any reference to more than one component or step may include a singular embodiment or step.

In accordance with various exemplary embodiments, a firearm actuation system is described. The actuation system comprises a handle, which is slidably coupled to a housing, and is capable of engaging the bolt carrier assembly carried by the housing. The side handle protrudes from the side of the housing. In the context of the AR-15 assault rifle ("AR-15"), this configuration allows a shooter to engage the handle when the rifle is in a shouldered firing position.

The AR-15 and its variants are gas-operated, modular, semi-automatic rifles. As originally designed, the rear-mounted actuation handle of the AR-15 (and related variants like the M-16, AR-10, etc.) was installed such that it protruded from the rear of the upper assembly and moved along the long axis of the rifle. In particular, the actuation handle was configured with a T-shaped handle that allowed a user to pull the actuation handle causing it to cycle the bolt carrier as the actuation handle was pulled toward the butt-plate of the stock.

The rear-mounted actuation handle presents two primary problems for today's user. First, newer models and variants of the AR-15 have been designed and built with a removable carry handle that couple to a modular rail, which is machined in or otherwise, coupled to the top of the upper assembly. This rail allows a user to attach various accessories, such as, scopes, electronic sites, lighting systems, red dot and laser sighting systems, etc., to the upper assembly of the AR-15. The addition of these accessories has provided additional functionality to the rifle. However, the location of the rear actuation handle has made operation of the AR-15 more difficult because of dimensional clearances between the rear actuation handle and the various accessories when installed on the modular rail or the carry handle. Second, the location of the rear-mounted actuation handle makes it difficult to cycle the firing pin and bolt carrier assembly ("action") when a user has the AR-15 shouldered in a firing position.

The firearm actuation system provided herein addresses both of these problems by removing the rear-mounted actuation handle and replacing it with a side actuation handle. For example, the side actuation handle comprises an ergonomically shaped (contoured) handle coupled to a base with a spring loaded hinge. The spring loaded hinge allows the handle to fold in toward the upper assembly for storage once the action has been cycled. The side actuation handle addresses the clearance issue discussed above by re-locating the actuation handle interface from the top of the upper assembly to the side of the upper assembly opposite the ejector port. As such, the user is able to cycle the AR-15 action without the interference from an accessory installed along the modular rail of the upper assembly and to cycle the AR-15 action while maintaining a shouldered firing position.

In accordance with an exemplary embodiment, the upper assembly comprises a housing, a barrel interface, and a housing door. The barrel interface may be coupled to or otherwise integrally configured with the housing. The housing may be configured with feed ramps. The housing may also comprise a rail. The rail may be configured with indicators. A user may use the indicators as landmarks to determine a mounting position. The upper assembly may further comprise a bolt carrier, coupled to a firing pin. The bolt carrier may be configured with a notch such that the bolt carrier may be engaged by a bolt engagement assembly at the notch. The bolt engagement assembly may be coupled to an actuation handle with a hinge which may comprise a detent assembly such that the handle may have at least an active position and a passive (stored) position.

It should be noted that while various exemplary embodiments relate to the AR-15, aspects of the present invention can be incorporated into various other assault rifles or other firearm configurations, such as, for example, M-16 and AR-10 or other assault rifles, and the present disclosure with an AR-15 is merely for illustrative purposes.

In accordance with various exemplary embodiments and with reference to FIG. 1A, actuation system 100 may be any system, mechanism, or assembly configured to actuate a firing assembly of a semi-automatic rifle. Actuation system 100 may comprises actuation handle system 140, bolt assembly 110, and housing 101. Actuation handle system 140 and bolt assembly 110 may each be operatively installed in housing 101.

Figure 1B:
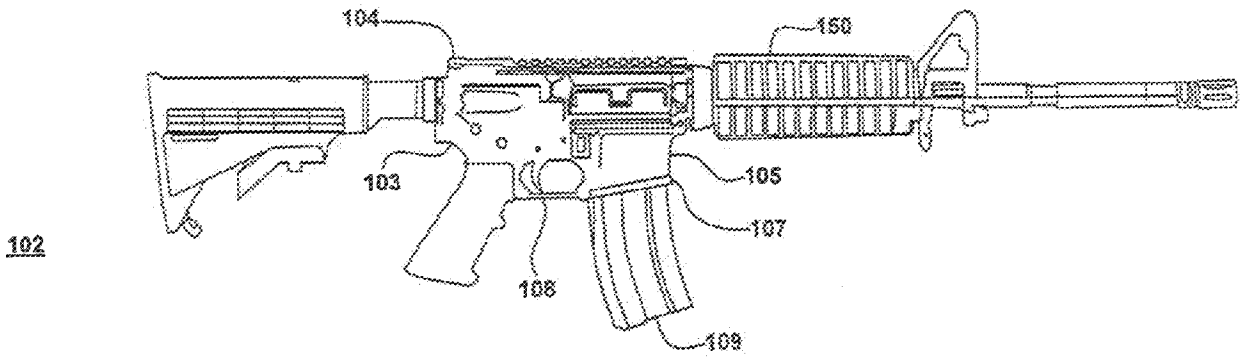
FIG. 1B illustrates an AR-15 in accordance with various exemplary embodiments.

In an exemplary embodiment and with reference to FIG. 1B, an AR-15 102 is provided. AR-15 102 comprises a receiver 103 with two primary receiver assemblies, an upper assembly 104 and the lower assembly 105, a barrel assembly 150, and various other components included for example a removable stock, a forward site, a rear site, and the like. Upper assembly 104 and lower assembly 105 may be operatively coupled together. Upper assembly 104 may also operatively couple to barrel assembly 150.

In an exemplary embodiment, upper assembly 104 generally comprises a housing, which is adapted to carry a spring-loaded bolt carrier and firing pin assembly. The bolt carrier may be cycled with an actuation handle. The housing is coupled to a barrel assembly, such that the firing pin and bolt carrier assembly and the barrel assembly are aligned along a common centerline. The common centerline allows the bolt carrier to engage a round of ammunition and seat the round properly in the barrel assembly 150 at the barrel inlet.

In an exemplary embodiment and with continued reference to FIG. 1B, lower assembly 105 may comprise a magazine well 107, a trigger assembly 108 and various other components including a handle, a magazine release, and the like. Magazine well 107 may be configured to removable couple with a magazine 109.

Figure 2A:
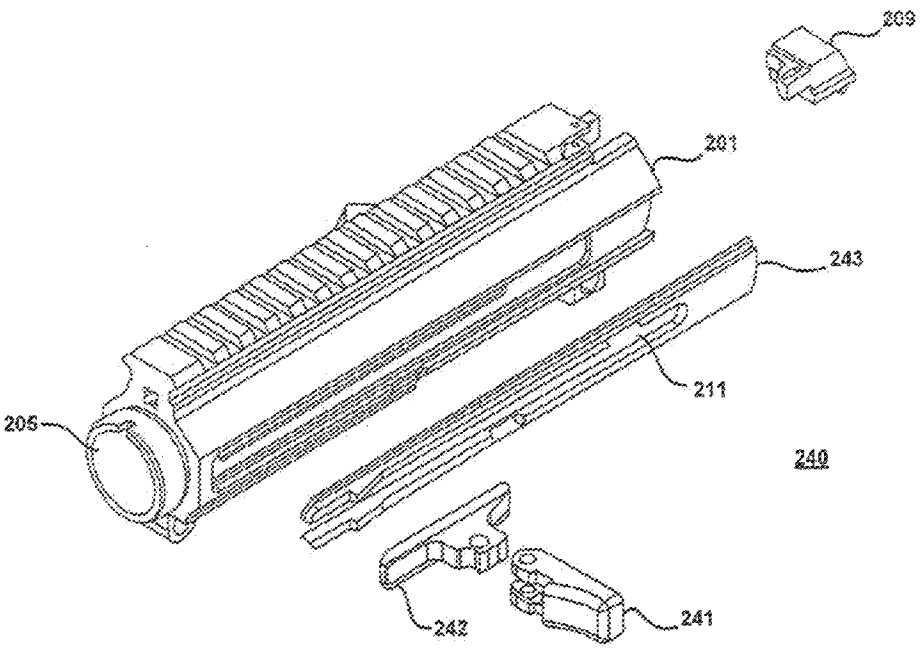
FIG. 2A is an exploded view of an AR-15 upper housing and associated actuation handle assembly in accordance with various exemplary embodiments.

In an exemplary embodiment and with reference to FIG. 2A, an actuation handle system 240 may comprise actuation handle 241, a handle engagement 242, and a guide 243. Actuation handle 241 may be operatively coupled to handle engagement 242. Handle engagement 242 may be coupled to guide 243. Guide 243 may be configured with a slot and rails such that handle engagement 220 may move along the rails. Housing 201 may comprise a channel 250. Guide 243 may be configured to slidably engage channel 250 when actuation handle system 240 is installed in housing 201. Where handle engagement 242 is installed with guide 243 in housing 201, handle engagement 242 is configured to engage bolt carrier.

In accordance with an exemplary embodiment, a housing 201 may be any metal, composite, plastic, or similar material structure configured to carrying an assembly capable of firing a round of ammunition.

In one embodiment, housing 201 may be a machined, metal structure. The housing may be made of a metal alloy, including for example, an aluminum alloy, such as "AL 6061 T-6", "AL 7075", a steel alloy, a composite, and/or the like. Housing 101 may also be a forged metal structure. The forging is finished machined to achieve appropriate assembly tolerances.

In an exemplary embodiment, housing 201 may be coated and/or plated with an anodize coating, a chrome plating, a Teflon coating, or similar coating, such that housing 201 is resistant to corrosion and wear. In an exemplary embodiment, housing 201 is coated with Type III, Class II Black Anodize, in accordance with Military Specifications A-8625.

In an exemplary embodiment, housing 201 may be configured with a barrel engagement 205. Barrel engagement may be operatively coupled to housing 201 or otherwise integrally formed as a feature of housing 201. Housing 201 may be configured to operatively couple to a barrel assembly 150, as shown in FIG. 1, at barrel engagement 205. Barrel engagement 205 may be a threaded adapter or any other mechanism suitable configured to operatively couple housing 201 to barrel assembly 150.

In an exemplary embodiment and with reference to continued reference to FIG. 2A, housing 201 may be coupled to a housing door 209. Housing door 209 may any hinged mechanism configured to be installed and rotatably engage housing 201. Housing door 209 may be removed or rotated to provide access to the internal cavity of housing 201. This access allows a user to install and/or remove a bolt carrier assembly from housing 201.

In an exemplary embodiment, actuation handle 220 may be any suitable user interface. Handle 241 may be configured so that a user may engage handle 241 to cycle bolt assembly 210. In one embodiment, handle 241 may be a contoured handle comprising a spring and detent assembly. The spring and detent assembly provides that handle 241 may be position for active engagement by a user and passive storage. Handle 241 may be made of metal, composite, or hard plastic and coated such that it is corrosion and wear resistant, as discussed above.

Figure 2B:
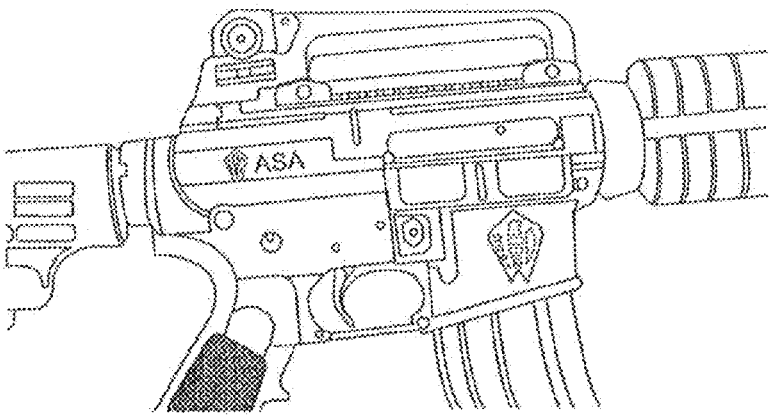
FIG. 2B illustrates an action-open-position in accordance with an exemplary embodiment.
Figure 2C:
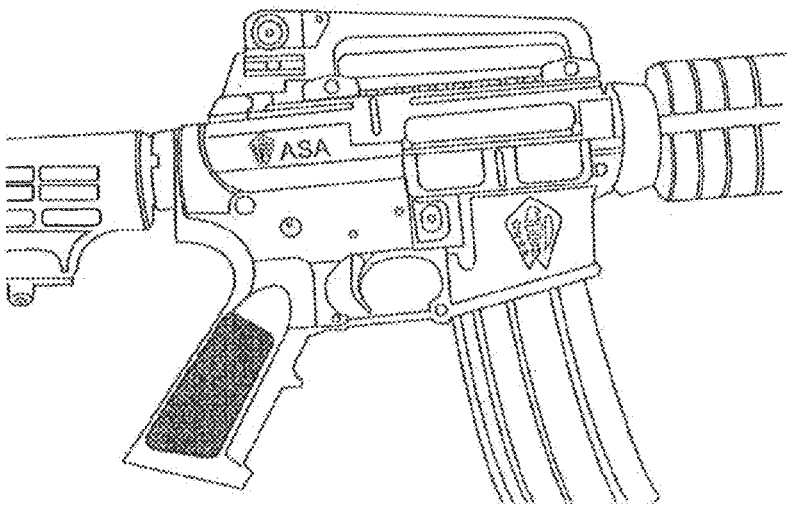
FIG. 2C illustrates an action-closed-position in accordance with an exemplary embodiment.

In an embodiment, handle 241 may be rotatable in the active or passive position. For example, in an active position, handle 241 may be configured to rotate such that bolt assembly 210 is retained in an action-open-position. In an exemplary embodiment and with momentary reference to FIG. 2B, the action-open-position is provided. Handle 241 may be retained in a slot 211 in housing 201 and/or guide 243. A retaining force may be provided by the spring loaded bolt assembly. The retaining force causes handle 241 to engage housing 201 such that handle 241 is retained in slot 211. In order to active the action, and return the bolt to the action-closed-position, the user must exert a force on handle 241 such that the handle is rotated and force from the spring causes the bolt to travel to the action-closed-position. In an exemplary embodiment and with momentary reference to FIG. 2C, the action-closed-position is provided.

Figure 3A:
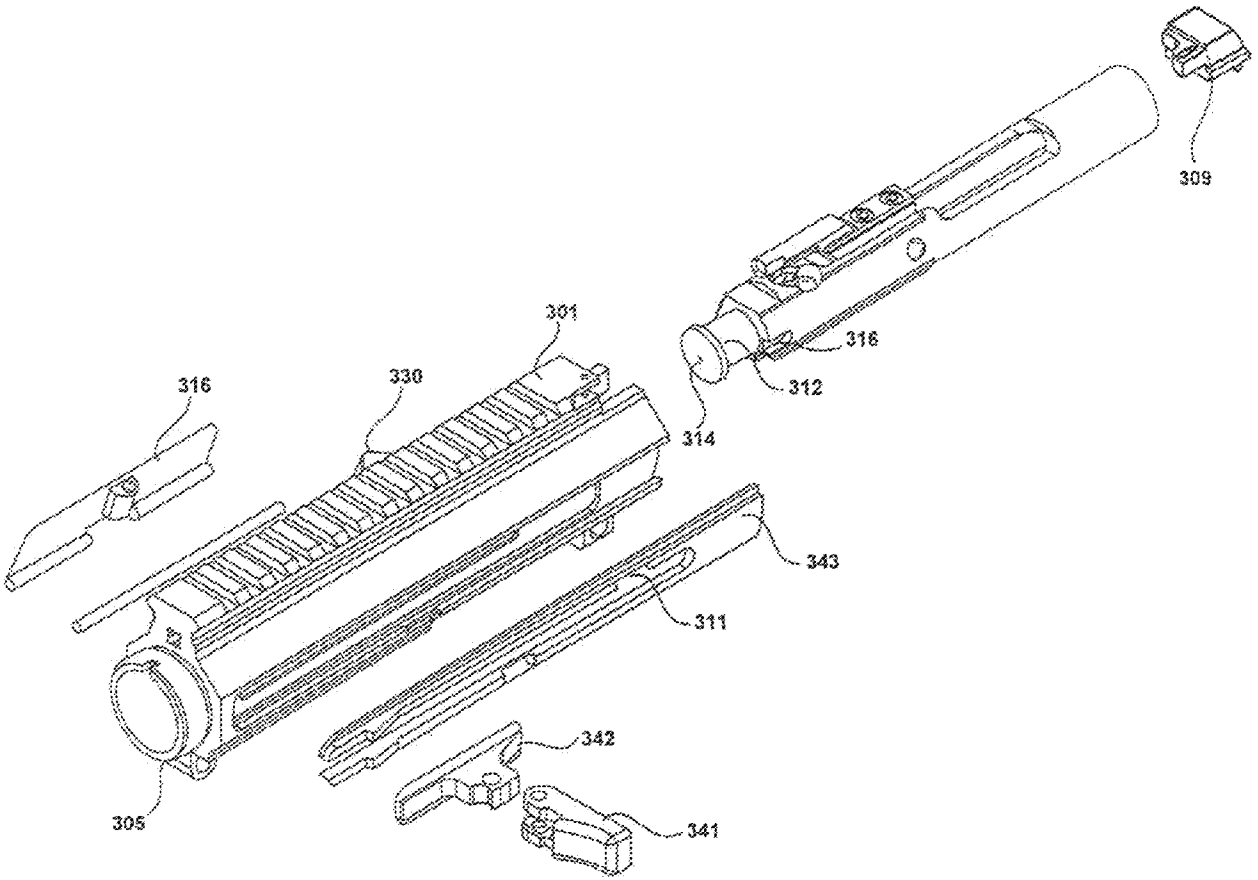
FIG. 3A is an exploded view of an AR-15 upper receiver housing and assembly in accordance with various exemplary embodiments.

In an exemplary embodiment and with reference to FIG. 3A, housing 301 may slidably couple and carry bolt assembly 310. Bolt assembly 310 may comprise bolt carrier 312 and firing pin 314. Bolt Assembly 310 may also be configured with a notch 316 and a forward assist engagement 318 (not shown). Bolt carrier 312 is configured with a through hole, such that firing pin 314 engages and is carried in bolt carrier 312 in the through hole. In accordance with an exemplary aspect, bolt carrier 312 and firing pin 314, barrel assembly 150 (as shown if FIG. 1) and barrel engagement 305 share a common centerline when bolt carrier 312 and firing pin 314 are installed in housing 301.

In an exemplary embodiment, forward assist engagement 318 may be configured to operable engage bolt carrier 312. Forward assist engagement 318 may be utilized to help properly seat bolt carrier 312 and a round of ammunition at the barrel inlet of barrel assembly 150. The proper seating allows the round of ammunition to be properly engaged by firing pin 314, so that the round of ammunition can be successfully fired.

Figure 3B:
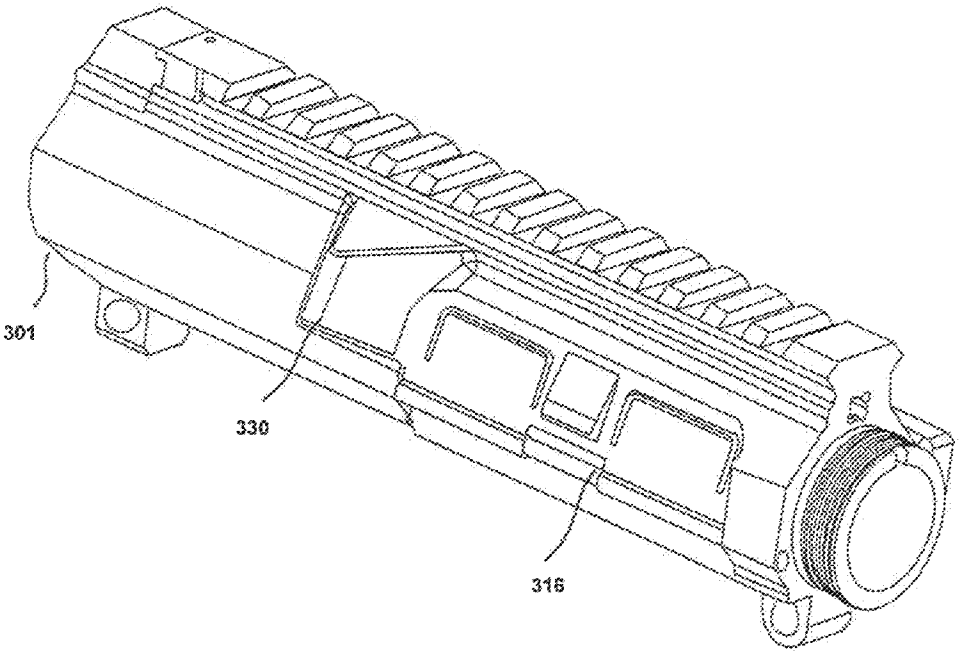
FIG. 3B is a perspective view of an AR-15 upper receiver housing and assembly in accordance with various exemplary embodiments.

In an exemplary embodiment and with reference to FIGS. 3A and 3B, housing 301 may further comprise a brass deflector 330. Brass deflector 330 is coupled to housing 301 at a position adjacent to an ejection port 315 and ejection cover 316. In an embodiment, brass deflector 330 may be removably coupled to housing 301. In an embodiment, brass deflector may be integrally formed as a feature of housing 301. Brass deflector 330 may be configured in accordance with Military Specifications.

In an exemplary embodiment, bolt assembly 310 comprises a notch 316 to facilitate engagement with handle engagement 342. Notch 316 may be a feature that is machined, cast, or otherwise created in bolt carrier 312. Notch 316 may also be a separately attached structure configured with a notch and capable of being coupled to bolt carrier 312. In various embodiments, Notch 316 may be any size notch dimensioned such that it may be engaged by handle engagement 342. In an embodiment, notch 316 may be dimensioned such that it has a width is between approximately 0.010 inch and 0.400 inch and a depth between approximately 0.010 inch and 2.000 inches. In an embodiment, notch 316 may be dimensioned such that it has a width is between approximately 0.150 inch and 0.350 inch and a depth between approximately 0.100 inch and 0.400 inch. In an embodiment, notch 316 may be dimensioned such that it has a width is between approximately 0.200 inch and 0.300 inch and a depth between approximately 0.150 inch and 0.350 inches.

Figure 4:
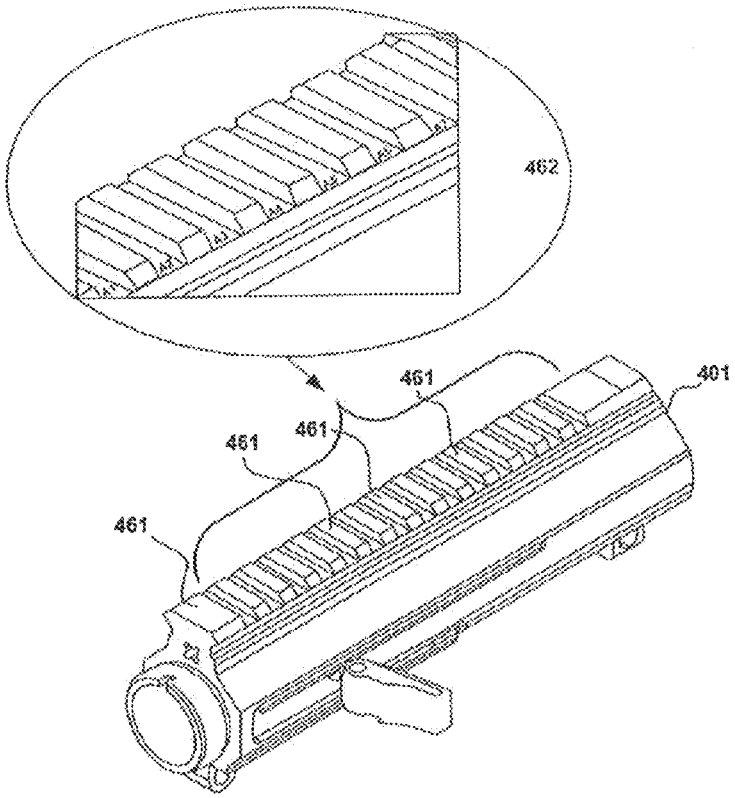
FIG. 4 is a perspective view of an AR-15 housing and mounting rail system in accordance with various exemplary embodiments.

In accordance with an exemplary embodiment and with reference to FIG. 4, housing 401 may comprise a mounting rail 460. Mounting rail 460 may be configured as a bracket or rail. Mounting rail 460 may be operatively coupled to housing 401, such that mounting rail 460 is a mounting platform. Mounting rail 460 may be a machined feature of housing 401 or may be an attachable structure. Mounting rail 460 may be made of metal, composite, plastic or any other suitable material. Mounting rail 460 may comprise a plurality of grooves 461. Grooves 461 are configured to accept various mounting systems coupled to accessories such as optics, sighting systems, lighting systems, and the like (not Shown). In an exemplary embodiment, mounting rail 460 is a picatinny rail conforming to Military Standard 1913. Mounting rail 460 may further comprise a plurality of unique indicators 462. Indicators 462 may be inscribed or otherwise shown in the space between each of the plurality of grooves 461, such that each groove is marked with a unique identifier. Indicator 462 allows the position of an accessory to be installed repeatedly at a known location.

Figure 5:
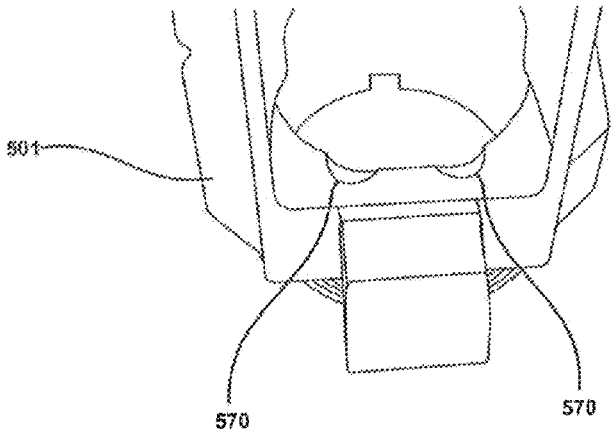
FIG. 5 is a bottom view of an AR-15 upper housing in accordance with various exemplary embodiments.

In an exemplary embodiment and with reference to FIGS. 1 and 5, housing 501 may comprise a feed ramp 570 or a pair of feed ramps 570. Feed ramps 570 may be configured as grooves in housing 501. In an embodiment, where housing 501 is configured to receive double stack magazine 109 (e.g. a magazine which is configured to provide rounds of ammunition from alternating positions), housing 501 may be configured with a pair of feed ramps 570. The feed ramps may be positioned in housing 501 such that feed ramps 570 provide a path for a round of ammunition from the magazine to barrel assembly 150 at each of the alternative ammunition positions in double stack magazine 109. In an exemplary embodiment, where housing 501 is at least part of upper assembly 104, feed ramps 570 may be configured in housing 501 such that they are adjacent to magazine well 107 of lower assembly 105. In an exemplary embodiment, feed ramp 570 may have, a radius of approximately 0.200 inch to 0.350 inch.

In an exemplary embodiment and with reference to FIGS. 1, 2A and 5, AR-15 102 may be provided with an actuation handle system 240 and feed ramps 570. This configuration may allow the omission of a forward assist engagement. In particular, the feed ramps 570 enable rounds of ammunition to travel more freely (with less friction) as they pass from the magazine to the barrel inlet, limiting the need for the forward assist feature. Further, by providing actuation handle system 240 which is engagable by a shooter from a shouldered firing position, the shooter is able to cycle the action of a gun allowing a fouled or improper seated round to be expelled from the receiver. In a conventional AR-15, a shooter would have to cycle the action by lowering the AR-15 from a firing position so that the shooter could engage the rear-mounted "T" shaped handle. Thus it was advantageous to provide a forward assist which would allow a shooter to seat a round, without leaving a shouldered firing position. However, where the AR-15 is configured with actuation handle system 240, the action can be cycled easily without the need to lower the AR-15 from the Shouldered firing position. As such, in an exemplary embodiment, an AR-15 may be provided with actuation handle system 240, feed ramps 570 and no forward assist mechanism.

The exemplary embodiment described herein set forth firearm actuation apparatuses, systems and methods that are applicable to various firearms. It will be understood that the foregoing description is of exemplary embodiments of the invention, and that the invention is not limited to the specific forms shown. Various modifications may be made in the design and arrangement of the elements set forth herein without departing from the scope of the invention. For example, the size and shape of the housing, handle, bolt and/or the like, can comprise any arrangement now known or hereinafter devised. These and other changes or modifications are intended to be included within the scope of the present invention, as set forth within the following claims.

What is claimed is:

1. An upper receiver for a firearm, comprising:

a housing defining an internal cavity;

a mounting rail coupled to said housing, said mounting rail configured with a plurality of grooves;

a first unique indicator inscribed in a first groove of the plurality of grooves;

a second unique indicator inscribed in a second groove of the plurality of grooves;

a guide defining a guide slot, said guide is retainably installed within said housing such that said slot provides access to said internal cavity;

a positionable actuation handle assembly; and a bolt installed within said housing and engagable by said positionable actuation handle assembly.

2. The upper receiver of claim 1, wherein the upper receiver is configured to couple to a lower receiver.

3. The upper receiver of claim 1, wherein said positionable actuation handle assembly is engagable by a shooter from a shouldered firing position.

4. The upper receiver of claim 1, wherein said housing further comprises a retaining slot.

5. The upper receiver of claim 4, wherein said positionable actuation handle assembly is retained in said retaining slot to provide an action-open-position.

6. The upper receiver of claim 1, wherein the first unique indicator is an alpha-numeric indicator.

* * * * *